US005131797A

United States Patent [19]

Christiansen et al.

[11] Patent Number: 5,131,797

[45] Date of Patent: Jul. 21, 1992

[54] SWIPE TRANSFER ASSEMBLY

[75] Inventors: Robert M. Christiansen, Blackfoot, Id.; William C. Mills, McKeesport, Pa.

[73] Assignee: The United States of America as represented by the United States Department of Energy, Washington, D.C.

[21] Appl. No.: 677,510

[22] Filed: Mar. 21, 1991

[51] Int. Cl.[5] ..... B65D 17/42

[52] U.S. Cl. ..... 414/219; 49/40; 109/19; 109/66; 232/43.1; 414/8; 414/221; 414/146

[58] Field of Search ..... 414/8, 146, 217, 219, 414/220, 221, 411; 221/263; 222/367, 452; 49/40, 68; 109/19, 45, 46, 47, 48, 58.5, 66; 232/1 E, 43.1, 43.3, 44

[56] References Cited

U.S. PATENT DOCUMENTS

| | | | |
|---|---|---|---|
| 245,188 | 8/1881 | Marchand | 222/452 X |
| 373,537 | 11/1887 | Smith | 222/452 X |
| 405,891 | 6/1889 | Kell | 222/452 X |
| 746,681 | 12/1903 | Darragh, Jr. | 222/367 |
| 1,094,982 | 4/1914 | Davis | 222/452 |
| 1,556,911 | 10/1925 | Callender | 222/367 |
| 1,759,129 | 5/1930 | McClintock et al. | 109/66 |
| 1,852,053 | 4/1932 | Jendrek | 109/66 |
| 2,172,375 | 9/1939 | Gordon, Jr. | 414/219 |
| 2,393,997 | 2/1946 | Lehmann | 414/217 |
| 2,548,338 | 4/1951 | Behrens | 232/43.3 |
| 2,562,632 | 7/1951 | Mosman | 109/66 |
| 2,901,149 | 8/1959 | Richter | 222/367 |
| 3,045,615 | 7/1962 | Atchison | 49/68 X |
| 3,428,197 | 2/1969 | Fischer et al. | 414/217 |
| 3,693,870 | 9/1972 | Dominick et al. | 109/66 X |
| 3,702,101 | 11/1972 | Moore | 109/19 |
| 3,730,387 | 5/1973 | McConnell et al. | 222/452 X |
| 3,784,090 | 1/1974 | Markham | 109/66 X |
| 3,894,926 | 7/1975 | Lee | 414/219 X |
| 3,974,961 | 8/1976 | Dominick et al. | 109/66 X |
| 4,119,269 | 10/1978 | Söderberg | 109/66 X |
| 4,158,999 | 6/1979 | Sukolics | 109/19 |
| 4,174,058 | 11/1979 | Bassignani | 222/452 X |
| 4,348,966 | 9/1982 | Hastings | 49/40 X |
| 4,351,247 | 9/1982 | Clark | 109/19 |
| 4,354,785 | 10/1982 | Garnier | 414/8 |
| 4,411,575 | 10/1983 | Miller | 414/217 |
| 4,546,897 | 10/1985 | Maloy et al. | 220/277 |
| 4,605,469 | 8/1986 | Shih et al. | 156/610 |
| 4,668,153 | 5/1987 | Sperinck et al. | 414/411 |
| 4,676,712 | 6/1987 | Hayward et al. | 414/411 |
| 4,795,300 | 1/1989 | Tomaselli et al. | 414/217 |

FOREIGN PATENT DOCUMENTS

| | | | |
|---|---|---|---|
| 63288 | 8/1891 | Fed. Rep. of Germany | 222/367 |
| 81169 | 4/1971 | Fed. Rep. of Germany | 414/146 |
| 2939124 | 4/1981 | Fed. Rep. of Germany | 222/367 |
| 3330225 | 3/1985 | Fed. Rep. of Germany | 109/66 |
| 1315370 | 6/1987 | U.S.S.R. | 414/217 |
| 328300 | 4/1930 | United Kingdom | 109/46 |

*Primary Examiner*—Robert J. Spar
*Assistant Examiner*—Robert S. Katz
*Attorney, Agent, or Firm*—Virginia B. Caress; William R. Moser; Richard E. Constant

[57] ABSTRACT

The swipe transfer assembly is a mechanical assembly which is used in conjunction with glove boxes and other sealed containments. It is used to pass small samples into or out of glove boxes without an open breach of the containment, and includes a rotational cylinder inside a fixed cylinder, the inside cylinder being rotatable through an arc of approximately 240° relative to the outer cylinder. An offset of 120° from end to end allows only one port to be opened at a time. The assembly is made of stainless steel or aluminum and clear acrylic plastic to enable visual observation. The assembly allows transfer of swipes and smears from radiological and other specially controlled environments.

13 Claims, 3 Drawing Sheets

SWIPE TRANSFER ASSEMBLY

The Government has rights in this invention pursuant to Contract No. DE-AC11-76PN00014 awarded by the U.S. Department of Energy to Westinghouse Electric Corporation.

BACKGROUND OF THE INVENTION

1. Field of the Invention

The present invention relates to apparatus for the controlled transport of radiological swipes and smears between a controlled environment and a clean environment. The invention thereby enables analytical personnel to perform isotopic analysis of the items thereby transported.

2. Description of the Prior Art

Radiological control procedures require that all glove boxes and containments be breached by air lock methods only. In the past, designs for the transfer of radiological samples from glove boxes have included doors with piano hinges and mechanical door latches. Such systems can, undesirably, have both inner and outer doors which open simultaneously and, also, undesirably, the hinges and latches are prone to failure.

Typical of the prior art is U.S. Pat. No. 4,668,153 to Sperinck et al. which relates to an apparatus for posting materials into and out of an enclosure through a wall in the port of the enclosure. A container for the materials has a lid engageable with a door for the port and the container is supported in a cradle. An interlock bar extends between the port and a clamp assembly for the container, the bar being axially displaceable between the first and second positions. In the first position, one end of the bar arrests movement of the door release mechanism and in the second, the opposite end of the bar engages the clamp assembly for maintaining the container at the port.

It was in light of the prior art as just described that the present invention has beer conceived and is now reduced to practice.

SUMMARY OF THE INVENTION

The present invention is directed toward a mechanical swipe transfer assembly which can be used in conjunction with glove boxes and other sealed containments. It is used to pass small samples into or out of glove boxes without an open breach of the containment, and includes a rotational cylinder inside a fixed cylinder, the inside cylinder being rotatable through an arc of approximately 240 relative to the outer cylinder. An offset of 120 degrees from end to end allows only one port to be opened at a time. The assembly is made of stainless steel or aluminum and clear acrylic plastic to enable visual observation. The assembly allows transfer of swipes and smears from radiological and other specially controlled environments.

The invention is of simplified construction using readily available materials including aluminum or stainless steel and acrylic plastic. It can be readily mounted on the barrier between a clean environment and a controlled environment and can be easily used. A unit embodying the invention is compact, yet sufficiently large to accommodate items for transfer such as radiological samples.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
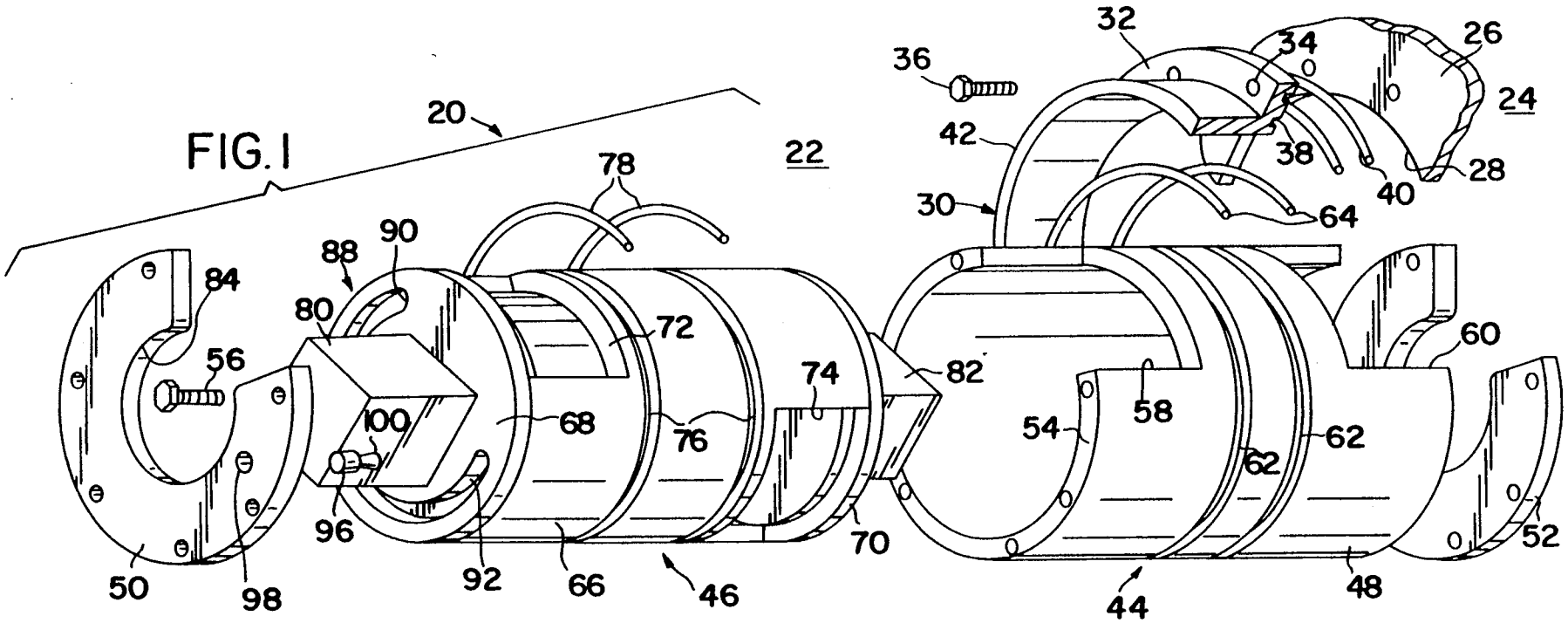
FIG. 1 is a perspective view, exploded, certain parts being cut away and shown in section, illustrating a transfer assembly embodying the present invention.
Figure 2:
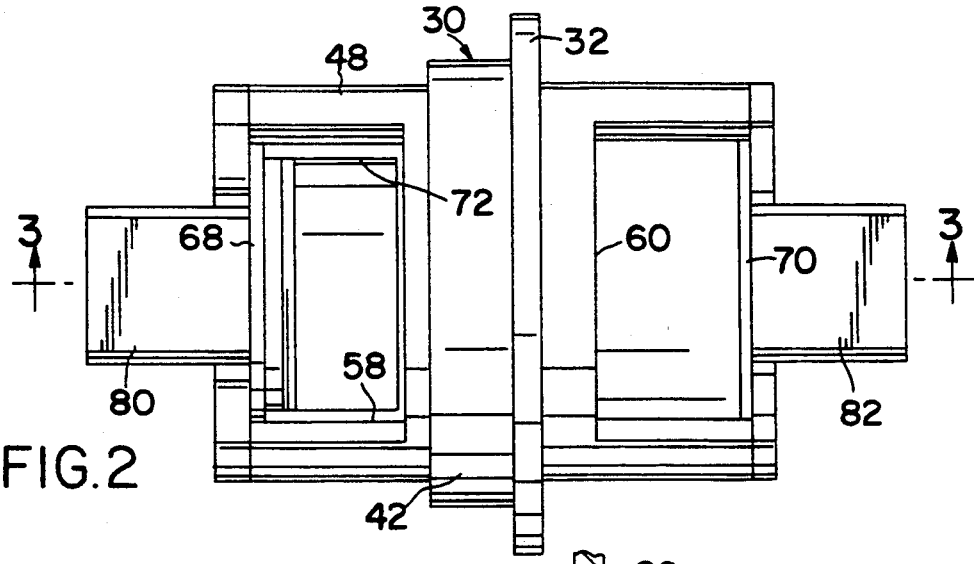
FIG. 2 is a top plan view of a transfer assembly of FIG. 1.

Turn now to the drawings and, initially, FIG. 1 which illustrates transfer apparatus 20 of the invention which serves to transfer articles between a clean environment 22 and a controlled or contained environment 24 while maintaining the integrity of the clean environment. A barrier 26 may be a wall with a suitably sized and shaped opening 28 through which radiological articles such as swipes and smears may be transferred.

For purposes of the invention, a flange member 30 includes an annular flange plate 32 with spaced holes 34 therein for reception of suitable fasteners 36 for attachment of the assembly to be described to the barrier 26. Annular grooves 38 are provided in a face of the flange plate 32 proximate the barrier 26 for fitting reception of suitably sized O-rings 40 as one means of sealing environment 22 from environment 44. An annular mounting collar 42 is integral with and extends away from the annular flange 32.

Figure 3:
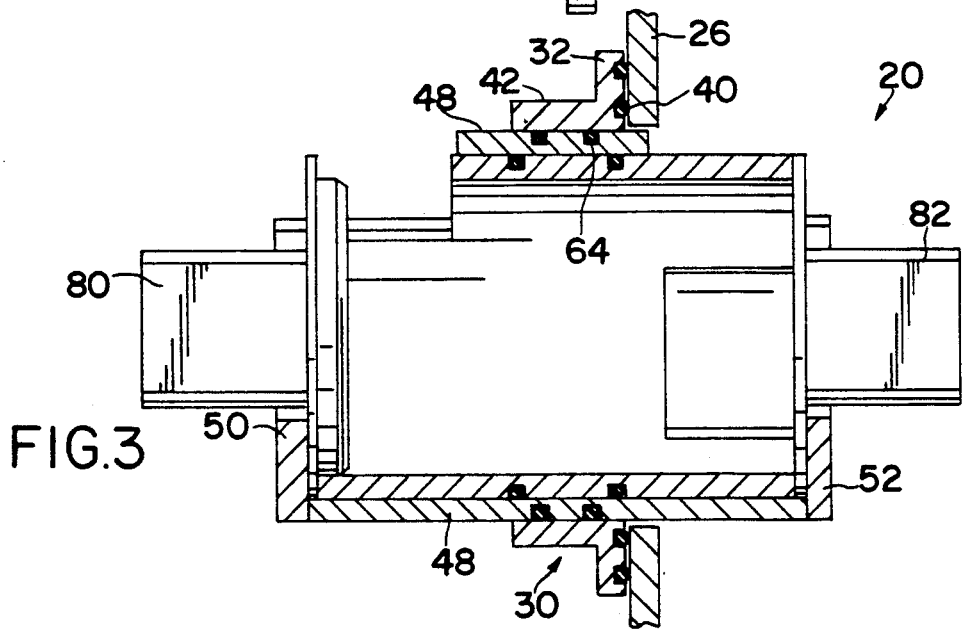
FIG. 3 is a cross section view taken generally along line 3—3 in FIG. 2.
Figure 5:
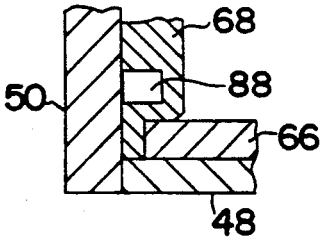
FIG. 5 is a detail cross section view of parts illustrated in FIG. 3.

With continued reference to FIG. 1, the transfer apparatus 20 includes outer and inner cylinders 44 and 46, respectively, which are of a unique design which enable the transfer of articles between environments 22 and 24 without deleteriously affecting the former. The outer cylinder includes an outer sleeve 48 which extends between first and second retainer caps 50 and 52, respectively. The retainer caps are suitably attached to opposed end surfaces 54 of the outer sleeve 48 as by means of fasteners 56. The outer sleeve 48 has a pair of circumferentially aligned openings 58, 60 at longitudinally spaced locations, each subtending an arc of approximately 100°. When the outer cylinder 44 is in its fully mounted position, the opening 58 will lie in the clean environment 22 while the opening 60 will lie in the controlled or contained environment 24. A pair of spaced, parallel, annular grooves 62 are formed in the outer surface of the outer sleeve 48 to receive mating O-rings 64 which in turn engage the inner surface of the annular collar 42 as particularly well seen in FIG. 3. It will be appreciated that the dimensions of the flange member 30 and of the outer cylinder 44 are chosen such that there is a sealing fit achieved by reason of the O-rings 64.

The inner cylinder 46 includes an inner sleeve 66 which extends between first and second end caps 68, 70, respectively. The end caps 68, 70 are suitably attached to the inner sleeve 66 as by glue. The inner sleeve is further formed with first and second ports 72, 74 in its outer peripheral surface and a pair of spaced, parallel, annular grooves 76 are also formed in the outer surface of the inner sleeve 66 to fittingly receive, respectively, O-rings 78. Operating handles 80, 82 are integral with and extend outwardly from their associated ends caps 68, 70, respectively. When the inner cylinder 46 is fully received within the outer cylinder 44, the handles 80, 82, extend through associated cut outs 84, 86 fashioned in the retainer caps 50, 52, respectively.

It will also be appreciated that the outer diameter of the inner sleeve 66 is only slightly smaller than the inner diameter of the outer sleeve 48 to assure a fitting and, therefore, sealing relationship between the O-rings 78 and the inner surface of the outer sleeve 48.

Figure 4:
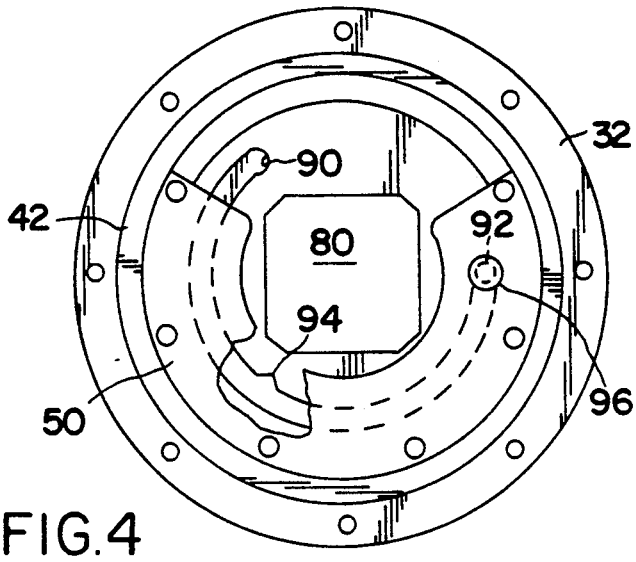
FIG. 4 is an end elevation view of a transfer assembly illustrated in FIG. 2, certain parts being cut away for clarity.

An incomplete annular groove 88 is formed in the surface of the end cap 68 which faces the retainer cap 50. The groove 88 extends through an arc of approximately 240° between detented ends 90 and 92 and has an intermediate detent 94 as well (FIG. 4).

A resilient plug 96 is fittingly received in a bore 98 provided in and extending through the retainer cap 50. A follower member 100 integral with and extends from the resilient plug 96 so as to be slidably engaged with the annular groove 88. By reason of its radial positioning on the retainer cap 50, the follower member 100 is biased into engagement with the innermost surface of the annular groove 88. Therefore, when the inner cylinder 46 is appropriately positioned relative to the outer cylinder 44, the follower member 100 can engage one of the three detents 90, 92, and 94. The ports 92 and 94 are positioned to be generally coextensive with their associated openings 58, 60, but not simultaneously. Indeed, an offset of at least 100° between a center of the port 72 from that of the port 74 assures that only one port will be opened at a time. The position of the annular groove 88 on the end cap 68 assures this desired result.

Figure 6C:
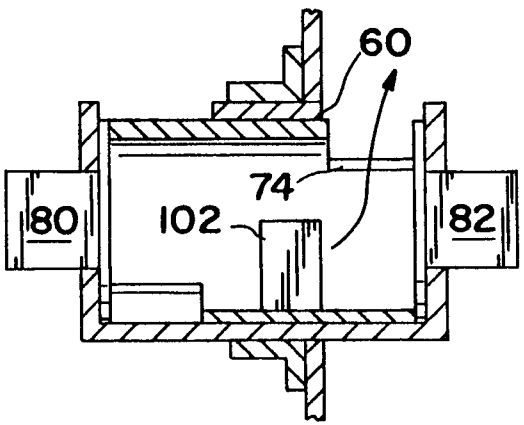
FIGS. 6A, 6B, and 6C are diagrammatic views, in section, similar to FIG. 3, illustrating, respectively, three successive positions of the transfer assembly of the invention.
Figure 6B:
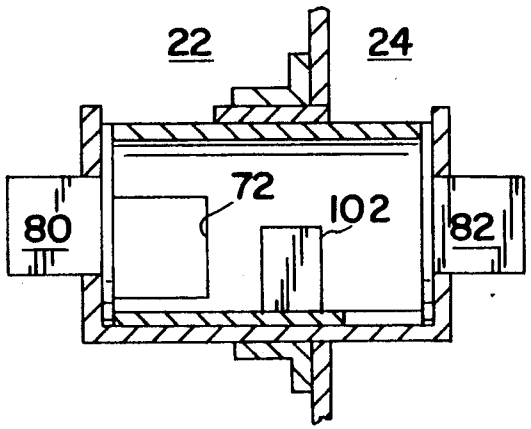
Figure 6A:
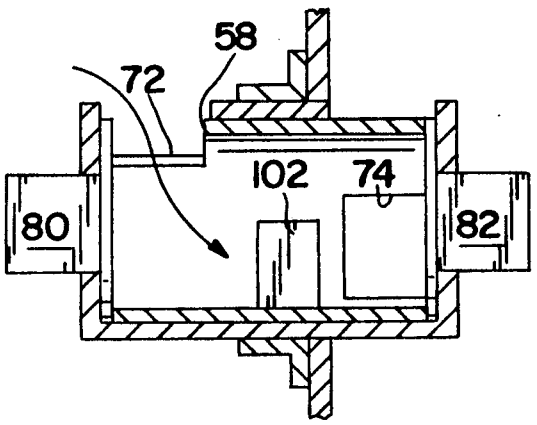

The operation of the invention will now be explained with primary attention to FIGS. 6A, 6B, and 6C. As seen initially in FIG. 6A, the operating handle 80 has been employed to move the inner cylinder 46 to an extreme position at which the follower member 100 is biased into engagement with the detent 92 of the annular groove 88. In this position, the port 72 is coextensive with the opening 58 of the outer cylinder 44. This enables placement of an article 102 to be transferred, such as a radiological swipe or smear, to be placed into the interior of the inner cylinder 46. Thereupon, the operating handle 80 is used to rotate the inner cylinder until the follower member 100 engages the intermediate detent 94 at which point the assembly assumes the position illustrated in FIG. 6B. At this point, the interior of the inner cylinder 46 is out of communication with either the clean environment 22 or the controlled environment 24.

With continued rotation of the inner cylinder by means of the operating handle 80, the inner cylinder 46 is rotated until the follower member 100 engages the detent 90. At this point, as seen in FIG. 6C, the port 74 of the inner cylinder is coextensive with the opening 60 of the outer cylinder thereby enabling removal of the article 102 from the interior of the inner cylinder.

Should replacement of the transfer apparatus 20 ever become necessary, the inner and outer cylinders can be pushed through the flange member 30 into the controlled environment 24 for disposal as contaminated equipment and replaced with a new unit.

While a preferred embodiment of the invention has been disclosed in detail, it should be understood by those skilled in the art that various other modifications may be made to the illustrated embodiments without departing from the scope of the invention as described in the specification and defined in the appended claims.

What is claimed is:

1. Apparatus for transferring articles between a first clean environment and a second controlled environment, having a barrier wall therebetween while maintaining the integrity of the clean environment comprising:

an outer cylinder fixedly mounted on and extending through said barrier wall isolating the first environment from the second environment, said outer cylinder having a longitudinal axis substantially perpendicular to said barrier wall and including:

first and second retainer caps at opposite longitudinal ends thereof; and an outer sleeve extending between said first and second retainer caps and having a first opening in the first environment adjacent said first retainer cap and a second opening in the second environment adjacent said second retainer cap, said first and second openings being located on the circumferential periphery of said outer sleeve;

an inner cylinder received in said outer cylinder and generally coextensive and coaxial therewith, said inner cylinder rotatable relative to said outer cylinder and including:

first and second end caps generally proximate said first and second retainer caps, respectively, said first and second retainer caps preventing longitudinal movement between said cylinders; and an inner sleeve extending between said first and second end caps and having a first port in the first environment adjacent said first end cap, the first port being aligned with the first opening at a first relative positioning of said inner and outer cylinders so as to enable communication between the first environment and the interior of said inner cylinder and a second port in the second environment adjacent said second end cap, the second port being aligned with the second opening at a second relative positioning of said inner and outer cylinders so as to enable communication between the second environment and the interior of said inner cylinder; and seal means between said outer and inner cylinders for isolating the first and second environments regardless of the relative positioning of said inner and outer cylinders.

2. Apparatus for transferring articles as set forth in claim 1 wherein the first opening and the first port are similarly sized and substantially coextensive at the first relative positioning of said inner and outer cylinders; and wherein the second opening and the second port are similarly sized and substantially coextensive at the second relative positioning of said inner and outer cylinders.

3. Apparatus for transferring articles as set forth in claim 2 wherein said first and second ports each extend circumferentially of said inner sleeve by a distance subtending an arc of less than one-third the circumference of said inner sleeve.

4. Apparatus for transferring articles as set forth in claim 1 wherein the outer diameter of said inner cylinder is only slightly smaller than the inner diameter of said outer cylinder; and wherein the outer length of said inner cylinder is only slightly smaller than the inner length of said outer cylinder.

5. Apparatus for transferring articles as set forth in claim 1 wherein said inner and outer cylinders are formed of transparent material to enable observation of procedures occurring therein.

6. Apparatus for transferring articles as set forth in claim 5 wherein said transparent material is clear acrylic plastic.

7. Apparatus for transferring articles as set forth in claim 1 including mutually engageable means on said inner and outer cylinders for enabling relative rotation therebetween to the extent of approximately plus or minus 240°.

8. Apparatus for transferring articles as set forth in claim 1 including stop means for limiting relative rotation between said inner and outer cylinders to approximately 240°.

9. Apparatus for transferring articles as set forth in claim 8 wherein said stop means includes:

an annular groove in said first end cap facing said first retainer cap and extending through an arc of approximately 240°;

a follower member, captured in a receiving cavity in said first retainer cap and engageable with said annular groove;

whereby rotation of said inner cylinder relative to said outer cylinder is limited to approximately 240°.

10. Apparatus for transferring articles as set forth in claim 9 wherein the relationship between said annular groove and the first and second ports is such that when the first port in said inner sleeve is coextensive with the first opening in said outer sleeve, the second port in said inner sleeve is distant from the second opening in said outer sleeve and such that when the second port in said inner sleeve is coextensive with the second opening in said outer sleeve, the first port in said inner sleeve is distant from the second opening in said outer sleeve.

11. Apparatus for transferring articles as set forth in claim 1 including:

flange means for supporting said outer cylinder on the barrier; and second seal means between said flange means and said outer cylinder for isolating the first and second environments.

12. Apparatus for transferring articles as set forth in claim 11 including:

an annular flange plate on said flange means for attachment to the barrier;

third seal means between said flange plate and the barrier for isolating the first and second environments; and an annular mounting collar integral with and extending away from said annular flange, said second seal means interposed between said collar and said outer cylinder.

13. Apparatus for transferring articles as set forth in claim 9 wherein said annular groove is formed with three detents equally spaced along said arc at increments of approximately 120°; and wherein said follower member is biased for engagement with said detents upon rotation of said inner cylinder relative to said outer cylinder.

* * * * *